US005513392A

United States Patent [19]

Douglas et al.

[11] Patent Number: 5,513,392

[45] Date of Patent: May 7, 1996

[54] SHOULDER PAD ACCESSORY

[76] Inventors: Treba F. Douglas; LaRisa F. Hutton, both of P.O. Box 941144, Atlanta, Ga. 31141

[21] Appl. No.: 342,883

[22] Filed: Feb. 2, 1995

[51] Int. Cl.[6] ..... A41D 27/00; A41D 27/08; A41D 27/26

[52] U.S. Cl. ..... 2/207; 2/267

[58] Field of Search ..... 2/207, 268, 104, 2/105, 106, 114, 115, 91, 1, 244; 450/86; D2/823, 824, 826, 856, 860, 728, 600, 500, 501, 502, 503, 504, 505, 506

[56] References Cited

U.S. PATENT DOCUMENTS

| | | | |
|---|---|---|---|
| D. 1,663 | 10/1862 | Townsend | D2/823 |
| D. 6,632 | 6/1873 | Landenberger, Jr. | D2/823 |
| 586,132 | 7/1897 | Lane | 2/88 |
| 1,037,518 | 9/1912 | Paull | 2/273 |
| 1,652,982 | 12/1927 | Grean | D2/500 X |
| 1,901,725 | 3/1933 | Blayney | 2/207 |
| 2,365,280 | 12/1944 | Lahm | 2/268 |
| 2,420,799 | 5/1947 | Siteman | 2/268 |
| 2,431,568 | 11/1947 | Kovitz | D2/500 X |
| 2,585,686 | 2/1952 | Rossant | D2/500 X |
| 2,624,884 | 1/1953 | Degron | 2/207 |
| 2,804,626 | 9/1957 | Rossiter | D2/500 X |
| 3,080,566 | 3/1963 | Neumann | D2/500 X |
| 3,618,140 | 11/1971 | Goldfarb | 2/207 |
| 4,343,045 | 8/1982 | Ferrari | D2/728 X |
| 4,468,818 | 9/1984 | Flannery | D2/500 |
| 4,675,917 | 6/1987 | Valli | 2/268 |
| 4,752,971 | 6/1988 | Meserol | 2/88 |
| 5,025,508 | 6/1991 | Duncan | D2/500 |
| 5,058,211 | 10/1991 | Hanks | 2/207 |
| 5,068,924 | 12/1991 | Ross | 2/268 |

*Primary Examiner*—Jeanette E. Chapman
*Attorney, Agent, or Firm*—James B. Middleton

[57] ABSTRACT

A clothing accessory covers the shoulders of a wearer, and provides shaping and decoration. Each accessory is elongated, having a center width sufficient to cover the wearer's shoulder. The accessory tapers down towards the ends to provide a pleasing shape. The shoulder pad is between two layers of fabric, and the two layers may be different so the accessory is reversible to yield different appearances. Preferably, one of the accessories will be placed on each shoulder over the wearer's usual garment, and they may be held in place with decorative pins fixed to the garment.

6 Claims, 1 Drawing Sheet

SHOULDER PAD ACCESSORY

BACKGROUND OF THE INVENTION

1. Field of the Invention

This invention relates generally to clothing accessories, and is more particularly concerned with a shoulder overlay accessory both for body shaping and for decorating garments.

2. Discussion of the Prior Art

The fashion world of accessorizing offers jewelry pieces and scarves, however has been long void of providing simple yet shapely and dramatic accessory pieces that are reversible, and can quickly change and enhance, and economically extend a wardrobe.

The fashion world industry has long desired achievement of a figure flattering, defined shoulder shape for decades. Toward this goal, various forms of shoulder pads have been designed to be conventionally sewn beneath garments such as dresses, blouses, jackets or coats, or to loop around underwear, or to lay directly on the skin. Therefore, in the case of shoulder shape, this portion of the female body has not been totally neglected. However, providing shoulder shaping and accenting a wardrobe simultaneously in a reversible shoulder accessory has not been done.

The biggest drawback of the prior art arrangements was the propensity for displacement or bunching, or as with wear to lose the support and lift, especially if the shoulder pads were too thin initially, as is often the case in retail garments. All too often shoulder pads would slip out of place while being worn, or get lost at the cleaners, or frumple and disintegrate when washed. Thus, the wearer's only option on the market was to remove the frumpled pads and replace with pads she can only wear underneath clothing. Even the prior art, the brassiere undergarment placed next to the skin, with inclusive shoulder pads can be cumbersome and limiting with other undergarments. In other words, foundational padding and their use is limited to only that, offering padding but not changing the outward decorative appearance of one's garment. There have also been overlays on the market that have appeared as scarves or shawls. These have offered no defined, ultimate shape other than to drape. Nor have they offered reversibility of a second material, to offer a totally different look. In today's tight economy, the fashion industry is in need of more versatile and reversible accessories that can extend a wardrobe, yet also offer defined shaping.

SUMMARY OF THE INVENTION

The present invention provides at least one shoulder overlay accessory comprising a generally elongated shape. The accessory has a straight edge to be placed adjacent to the wearer's neck, the straight, or inner, edge extending down the wearer's front and back. The opposite, outer, edge extends out to cover the wearer's shoulder, the wearer's front and back and tapers inwardly to provide a pleasing shape. Generally centrally of the accessory, there is a shoulder pad to provide the desired body shaping. Decorative pins or the like are fixed to the accessory and to the garment thereunder to hold the accessory in place.

Though one of the accessories can be worn, the preferred embodiment of the invention comprises a pair of the accessories formed as mirror images of each other.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1A:
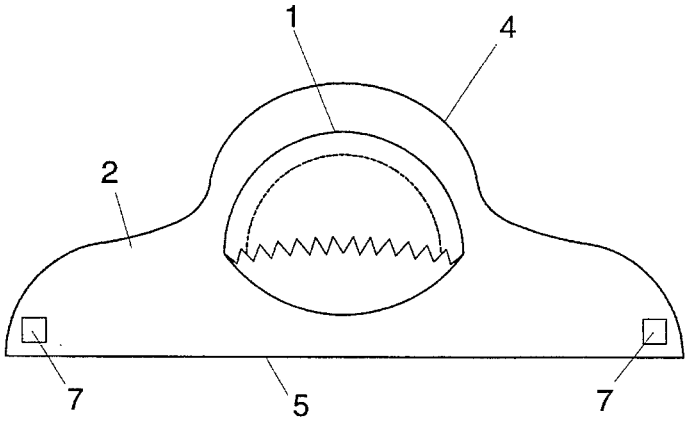
FIG. 1A is a plan view showing one principal pattern piece of the present invention with a conventional shoulder pad in place thereon.
Figure 1B:
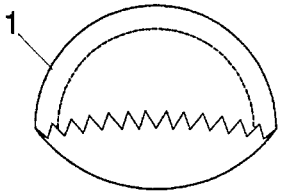
FIG. 1B is a plan view showing the shoulder pad as used in FIG. 1A.
Figure 2:
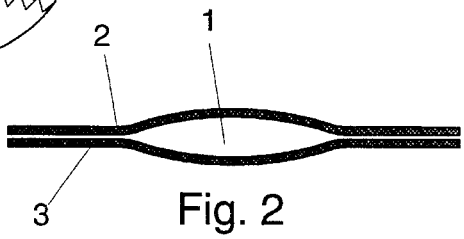
FIG. 2 is a longitudinal cross-sectional view taken through a completed accessory of the present invention.
Figure 3:
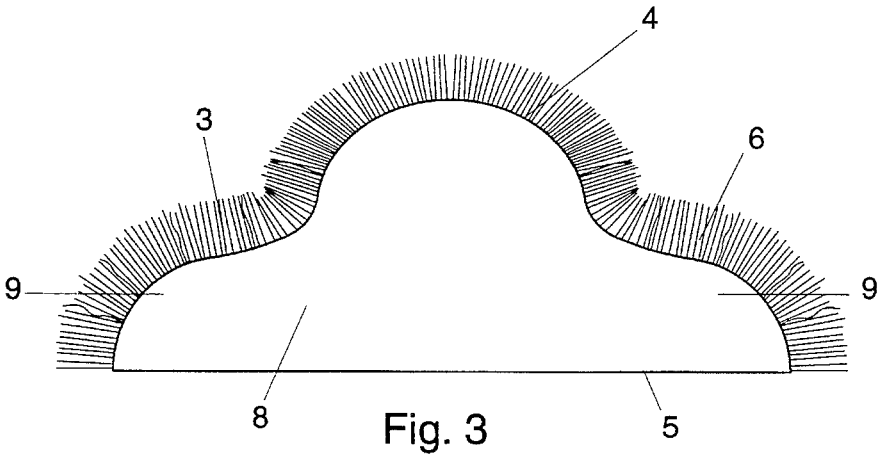
FIG. 3 is a plan view similar to FIG. 1A showing the opposite principal pattern piece of the present invention; and, FIG. 4 is a front elevational view showing a pair of accessories made in accordance with the present invention disposed on the shoulders of a wearer.
Figure 4:
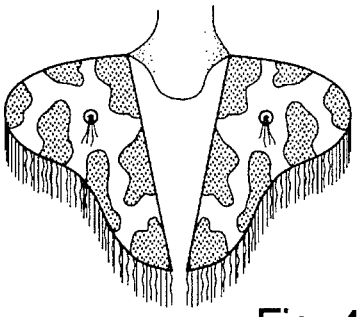

Referring now more particularly to the drawings, and to that embodiment of the invention here presented by way of illustration, FIG. 1B is a plan view showing the exposed shoulder pad as used in FIG. 1A. FIG. 1A is a plan view showing one principal pattern piece of the shoulder accessory with a conventional shoulder pad in place thereon from an interior view, and sheet material 2 placed right side down to receive the shoulder pad. FIG. 2 shows a longitudinal cross-sectional view taken through a completed shoulder accessory. The padded shoulder accessory is constructed of a shoulder pad 1 sandwiched inbetween two layers of sheet material 2 and 3. As shown in FIG. 1A and FIG. 3, the sheet materials 2 and 3 include a curved outer edges 4 and a inner straight edges 5. The curved outer edges 4 can include decorative fringe 6 or cording or other seam finishing ornamentation, and this must be sewn to right side of fabric before two layers of sheet material 2 and 3 are sewn together. It should also be noted that certain craft attachments or stones or paints may need to be applied to right sides of sheet materials 2 and 3 before they are sewn together. It should also be noted that some sheet materials may require one weight 7 at each narrow end of shoulder accessory to give weight control of the accessory, before the two sheet materials are sewn together. FIG. 3 shows the same shape as FIG. 1A, however the sheet material 3 is different material from sheet material 2. Once fringe, trim or ornamentation has been applied, place right sides of sheet material 2 and 3 together and position, securing the perimeter together by sewing all around the assembly, and leaving a four inch opening in the center of the inner straight edge 5 to pull the material inside out. Straighten this shoulder accessory and iron if needed, and hand finish the opening. Those skilled in the art will readily understand this procedure required, thus it is noted. Repeat the foregoing process to complete set of shoulder overlay accessory. FIG. 4 shows a front elevational view showing a pair of completed padded shoulder overlay accessories made in accordance with the present invention disposed on the shoulders of a wearer's garment. The shoulder overlay accessory is attached to garment by means of decorative pins.

In summary, the clothing accessory includes an elongated piece of sheet material with a center section 8 and two end portions 9. The sheet material includes an inner straight edge 5 disposed adjacent the wearer's neck and outer curved edges 4. One of the end portions overlies a portion of the wearer's back while the other overlies a portion of the wearer's chest when worn. The center section 8 is received on the wearer's shoulder, this section having a width sufficient to cover the shoulder. The shoulder pad 1 is fixed to the center section 8 of the sheet material for shaping the wearer's shoulder. The end portions 9 diminish in width between the center section and each end of the piece of sheet material. Again, there is a means to attach the shoulder or clothing accessory to the garment.

It is the primary object of the present invention to provide a shoulder wear accessory that is reversible and attachable, and which is primarily useful to accessorize and extend one's wardrobe, while simultaneously offering padded shaping to one's shoulders. It also may be readily reversed to convert to a totally different look, thus fulfilling the need previously mentioned, in today's economy of stretching the versatility of a wardrobe.

May it also be noted that, if our invention extends to manufacturing this accessory for men, we may or may not choose to include the shoulder pad, for obvious reasons of a man's stature.

It will of course be understood by those skilled in the art that the particular embodiment of the invention here presented is by way of illustration only, and is meant to be in no way restrictive; therefore, numerous changes, variations and modifications may be made, by us, the inventors, and the full use of equivalents resorted to, without departing from the spirit or scope of this invention as outlined in the appended claims.

We claim:

1. A clothing accessory to be worn over a garment, said accessory comprising an elongated piece of sheet material having a center section and two end portions, said center section is to be received on the shoulder of a wearer, said center section having a width sufficient to cover said shoulder, a shoulder pad fixed to said center section of said sheet material for providing shaping of said wearer's shoulder, said elongated piece of sheet material having an inner straight edge disposed adjacent to said wearer's neck and having curved outer edges; and one of said end portions being of a size sufficient to overlie a portion of the wearer's chest when said accessory is worn and the other of said end portions is of a size sufficient to overlie a portion of the wearer's back when said accessory is worn, said end portions diminishing in width between said center section and each ends of said piece of sheet material, and means for selectively fixing said accessory to an outer surface of said garment wherein a single clothing accessory is to be worn on each shoulder of a wearer.

2. A clothing accessory as claimed in claim 1, wherein said accessory further includes a second elongated piece of sheet material juxtaposed on said elongated piece of sheet material, said shoulder pad being disposed between said piece of sheet material and said second piece of sheet material.

3. A clothing accessory as claimed in claim 2, and including decorations fixed to said sheet material.

4. A clothing accessory as claimed in claim 3, wherein said decorations comprise a first group of decorations on said piece of sheet material and a second group of decorations on said second piece of sheet material, so that said accessory is reversible for providing different appearances.

5. A clothing accessory as claimed in claim 1, and further including weighting means fixed in each end of said accessory for retarding motion of such ends.

6. A clothing accessory as claimed in claim 1, wherein at least one of said means for selectively fixing said accessory to said garment and decorations fixed to said sheet material comprise pins extending through said accessory and said garment.

* * * * *